US006951407B2

(12) United States Patent
Herst et al.

(10) Patent No.: US 6,951,407 B2
(45) **Date of Patent: *Oct. 4, 2005**

(54) EDGE CONNECTABLE LIGHTING FIXTURE ASSEMBLY AND METHOD

(75) Inventors: Douglas J. Herst, Ross, CA (US); Utkan Salman, Oakland, CA (US); Michael Tran, Oakland, CA (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/851,463

(22) Filed: May 21, 2004

(65) Prior Publication Data

US 2005/0057922 A1 Mar. 17, 2005

Related U.S. Application Data

(63) Continuation of application No. 10/355,817, filed on Jan. 30, 2003, now Pat. No. 6,769,785.

(60) Provisional application No. 60/365,238, filed on Mar. 14, 2002.

(51) Int. Cl.[7] ..... F21S 8/00

(52) U.S. Cl. ..... 362/147; 362/219; 362/221; 362/404; 174/63

(58) Field of Search ..... 362/147, 217, 362/219, 221, 404, 406, 407, 408; 174/63

(56) References Cited

U.S. PATENT DOCUMENTS 6,769,785 B1 * 8/2004 Herst et al. ..... 362/147

* cited by examiner

*Primary Examiner*—John Anthony Ward
(74) *Attorney, Agent, or Firm*—Donald L. Beeson

(57) ABSTRACT

An edge connectable lighting fixture assembly has a lighting fixture housing for housing a light source and components for supporting and electrifying the light source including wiring. The housing has at least one laterally extending edge portion and a connecting structure extending along at least a portion of the length of the edge portion with a wire passageway passing through the connecting structure. An edge connector arm has at least one terminal end and a connecting structure formed on the terminal end of the arm which mechanically connects with the connecting structure formed along the edge portion of the housing so that the housing can be mechanically connected at its edge to the terminal end of the edge connector arm. A wireway in the edge connector arm extends to and exits from the terminal end of the edge connector arm such that the wireway can be aligned with the wire passageway in the connecting structure in the housing edge portion by aligning the terminal end of the edge connector arm to the wire passageway. Electrical wires can be passed from the edge connector arm through the edge portion of the housing.

11 Claims, 13 Drawing Sheets

EDGE CONNECTABLE LIGHTING FIXTURE ASSEMBLY AND METHOD

CROSS-REFERENCE TO RELATED APPLICATIONS

This application is a continuation of application Ser. No. 10/335,817 filed Jan. 30, 2003, now U.S. Pat. No. 6,769,785 which claims the benefit of provisional application No. 60/365,238, filed Mar. 14, 2002.

BACKGROUND OF THE INVENTION

The present invention generally relates to overhead lighting systems for producing lighting in an architectural space; it more particularly relates to lighting systems comprised of inter-connectable lighting fixture elements that can be configured to provide both a desired distribution of light and a physical lighting system having a design that compliments the surrounding architecture.

Linear flourescent lighting fixtures have been known for many years. Characterized by elongated fixture housings of a characteristic cross-sectional shape, usually fabricated of steel or extruded aluminum, such fixtures are designed to be suspended from ceilings or wall mounted and to produce ambient lighting within an architectural space in the form of indirect lighting, direct lighting, or a combination of direct and indirect lighting. Early linear lighting housing shapes were mostly basic round and rectangular shapes. However, over the years a variety of unique and aesthetically pleasing shapes have been introduced to give architects and lighting designers a greater selection of products from which to create more innovative, effective and architecturally pleasing lighting designs.

Interconnectibility is one of the important features of linear lighting systems. Presently, straight, T, L and X end connectors are available for joining the ends of individual fixtures together. These connectors are limited to end-to-end fixture configurations such as straight or intersecting runs, or geometric runs such as a closed square. Side connector systems have also been devised which permit linear fixture elements to be connected in a grid pattern. For example, U.S. Pat. No. 4,420,798 to Herst, et al., discloses an adjustable overhead lighting fixture having hanger elements mounted to the ends of the fixtures which fit over and engage the curved side walls of another fixture or runner element. The hanger elements on the ends of the fixtures are relatively bulky and provide a mechanical connection only without any facility to electrically interconnect the fixtures.

U.S. Pat. No. 3,158,327 to R. C. Dameral discloses an overhead flourescent lighting system comprised of an elongated rectangular ballast housing to which the ends of individual linear lighting fixture elements can be mechanically connected and through which the lighting fixture elements are wired to the ballast in the ballast housing. Again, the mechanical connection between the ballast housing and the fixtures is relatively cumbersome and provides no particular aesthetic appeal for the system. In such a system, the ballasts are also separated from the fixture elements, such that the fixture elements cannot act as stand-alone units which can be configured without the use of the ballast housing.

A need exists for a linear lighting system that can be interconnected and configured in a manner not heretofore provided in the prior art. More particularly, a need exists to provide an aesthetically pleasing linear lighting fixture component of a lighting system which can be interconnected with other linear lighting fixture components in a manner that is itself aesthetically pleasing and that permits the linear fixture elements to be easily interconnected, both mechanically and electrically, without the connecting structures dominating the visual appearance of the system.

The present invention provides an edge connectable linear lighting fixture assembly which can be easily interconnected mechanically and electrically, which is aesthetically pleasing, and which provides a lighting designer with a powerful tool for creating overhead lighting systems with an architectural motif that has not heretofore existed.

SUMMARY OF THE INVENTION

Briefly, the invention involves an edge connectable lighting fixture assembly comprised of a lighting fixture housing for housing a light source and components for supporting and electrifying the light source including wiring. The housing has at least one laterally extending edge portion and a first connecting structure extending along at least a portion of the length of this edge portion. The first connecting structure of the housing edge includes at least one wire passageway extending through the edge. An edge connector arm is provided for connecting to the extended edge of the fixture housing. This connector arm has at least one terminal end which has a second connecting structure formed to mechanically connect with the first connecting structure along the housing edge portion. A wireway in the edge connector arm extends to and exits the terminal end of the edge connector arm such that the wireway can be aligned with the wire passage in the first connecting structure of the housing edge portion. By aligning the terminal end of the edge connector arm to this wire passageway, electrical wires can be passed from the edge connector arm through the edge portion of the housing for providing electrical power to the housing.

DETAILED DESCRIPTION OF THE ILLUSTRATED EMBODIMENT

Figure 1:
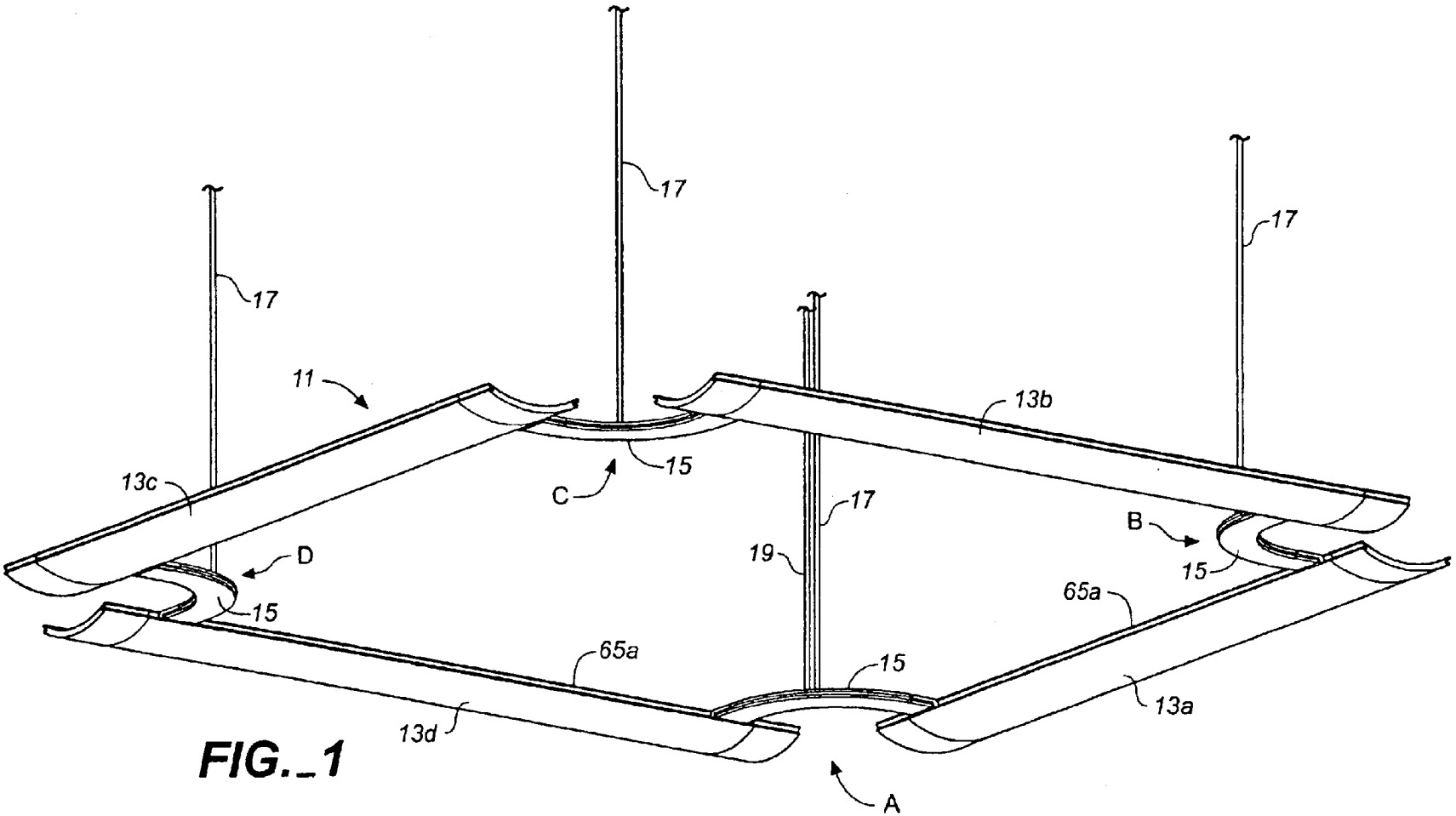
FIG. 1 is a bottom plan view of a ceiling suspended edge connectable linear lighting fixture assembly in accordance with the invention, consisting of four linear fixture housings interconnected by 90 degree edge connector arms in a square arrangement.

Referring now to the drawings, FIG. 1 shows a edge connectable linear lighting fixture assembly 11 having four substantially equal length linear lighting fixture elements 13 connected together by 90 degree edge connector arms 15 attached to suspension cables 17, which are used to suspend the entire fixture assembly from an overhead ceiling structure (not shown). The edge connector arms 15 connect to the edges of adjacent fixture elements as hereinafter described and, as also hereinafter described, provide a wireway for wiring one fixture to the other and for receiving an electrical feed from power cord 19. The edge connector arms are visually integrated with the edge of the lighting fixture elements and permit the lighting fixture elements to be supported proximate their ends without end connectors of the type heretofore used to join linear fixtures together in connected runs of fixtures, e.g. L, T, and X connectors. This permits different aesthetic treatments of the lighting fixture ends which would not be possible with traditional connectors. For example, in the lighting fixture assembly shown in FIG. 1, the individual fixtures of the assembly are interconnected at their edges such that the low profile fixture ends are free of any connecting structure and have the appearance of floating in space. (As described below, these free floating ends can be provided with visual accents to add visual interest to the fixture assembly.)

Figure 1A:
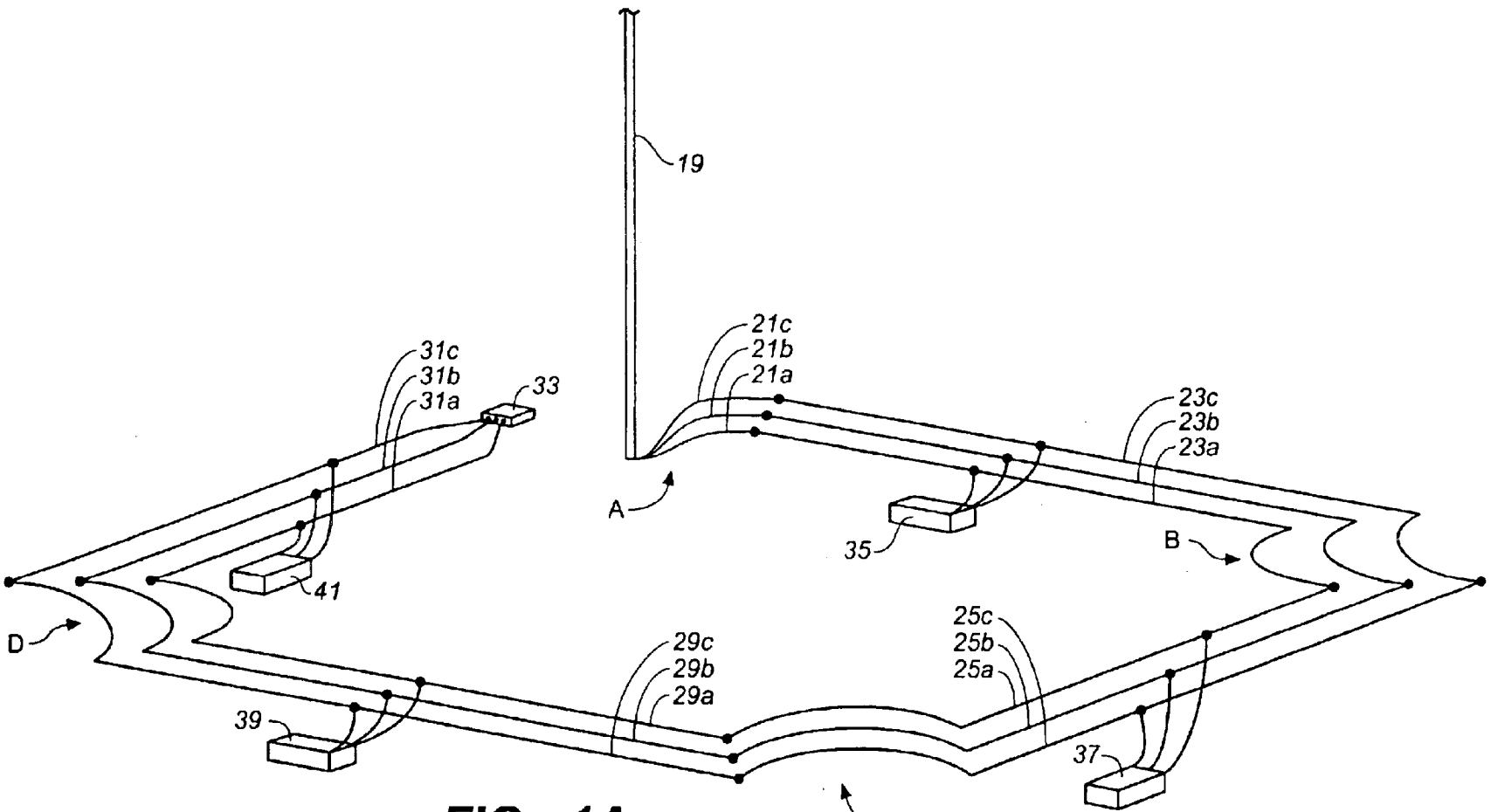
FIG. 1A is a pictorial wiring diagram for electrically interconnecting the lighting fixture housings of the lighting fixture assembly shown in FIG. 1.

FIG. 1A pictorially illustrates a wiring scheme for the lighting fixture assembly 11 shown in FIG. 1, wherein a three-wire power cord 19 is dropped from the overhead ceiling to one of the 90 degree edge connector arms 15 as shown in FIG. 1. The three wires 21*a*, 21*b*, and 21*c* of the power cord are passed through the connector arm as hereinafter described to preexisting internal wires 23*a*, 23*b*, 23*c* in the first linear lighting fixture element of the assembly. The internal wiring of the first lighting fixture element is provided with sufficient length to be threaded through the next 90 degree edge connector arm. Similarly, the internal wiring of each successive lighting fixture element of the assembly is wired to the next fixture through the next successive 90 degree edge connector arm (internal wires 25*a*, 25*b*, 25*c* to wires 29*a*, 29*b*, and 29*c*, and internal wires 29*a*, 29*b*, and 20*c* to internal wires 31*a*, 31*b*, and 31*c*). The internal wiring of the last in the series of linear lighting fixtures is terminated at a terminal block 33, which can be in the form of a conventional female wire connector. As illustrated in FIG. 1A, the internal wiring of each of the fixture elements is connected to the fixture ballasts 35, 37, 39, 41, which are in turn wired in a conventional manner to the lamp sockets of the fixtures.

Figure 2:
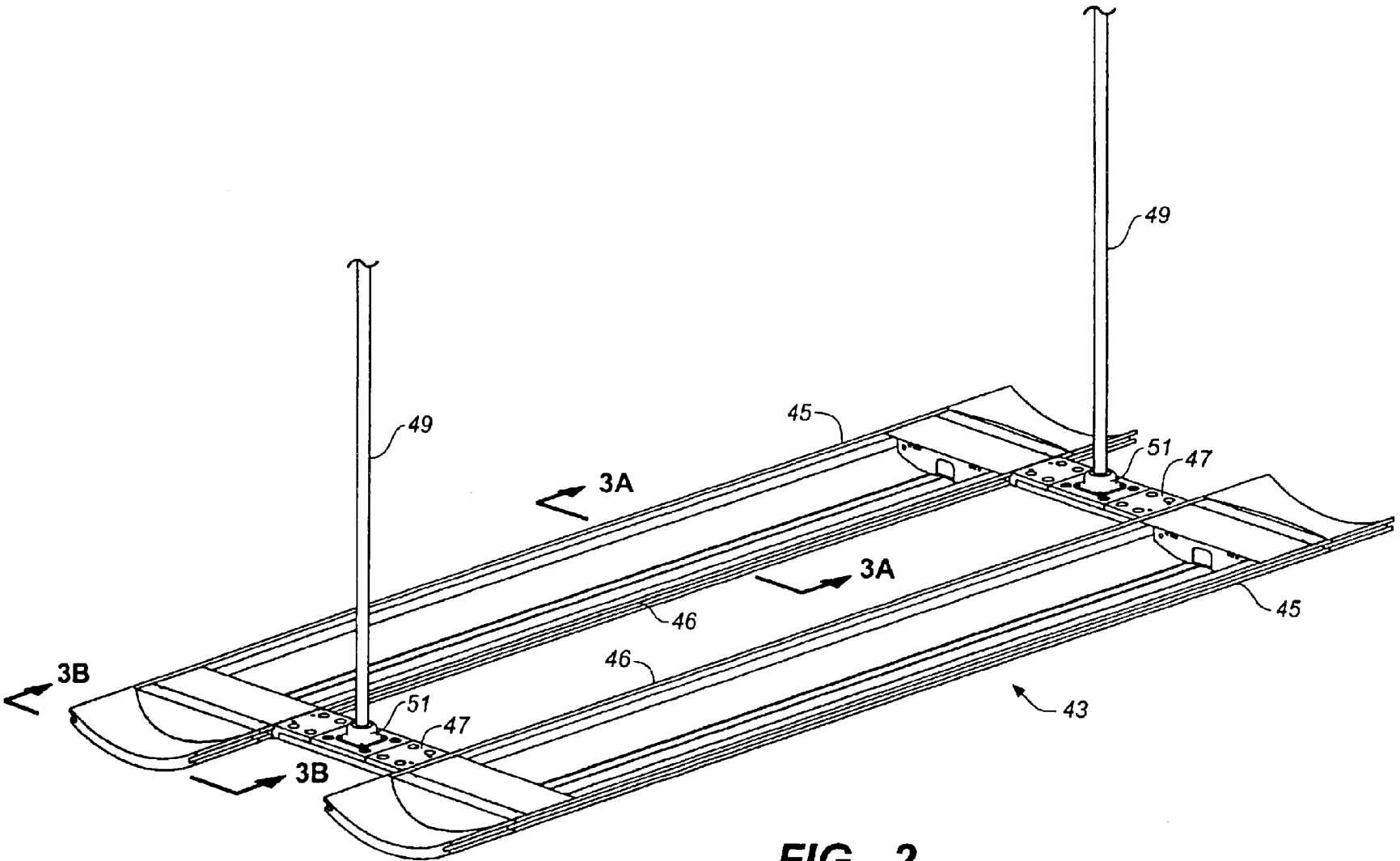
FIG. 2 is a top plan view of an edge connected linear lighting fixture assembly in accordance with the invention, showing a pair of lighting fixtures interconnected by the edge connector arm of the invention in a parallel arrangement.

FIGS. 1 and 1A are illustrative of just one of a large variety of lighting designs that can be created using the edge connectable lighting fixture assembly of the invention. Another example is illustrated in FIG. 2 which shows a linear lighting fixture assembly 43 comprised of two parallel linear lighting fixtures 45 connected together along one of their laterally extending edges 46 by straight edge connector arms 47. Connector arms 47 provide an edge connection to the fixtures in the same manner as provided in the assembly of FIG. 1. This connection is described in detail below. The parallel fixture assembly of FIG. 2 is suspended from the connector arms by stems 49 which are attached to the top of the edge connector arms by means of a suspension connector in the form of swivel ball connector 51. This creates suspension points for the fixture assembly at the assembly's connector arms. A power cord passed through one of the stems is wired to the ballasts of the fixtures through suitable wireways in the edge connector arms as also later described.

It is noted that the linear lighting fixture elements 45 of the configuration shown in FIG. 2 are identical to the lighting fixture elements 13 shown in the configuration illustrated in FIG. 1. It is contemplated that by supplying edge connector arms which sweep through different angles, a lighting designer can choose between system elements to create a desired lighting system configuration. In each case, the edge connector arms and lighting fixtures would interconnect in the same fashion, the difference being in the sweep angle and length of the connector arms. Further variety in design can be provided in the sweep geometry of the connector arm, which is a curve in the FIG. 1 embodiment, but which could provide an angulated sweep such as an L-shape.

FIGS. 3A–6B illustrate in greater detail the linear lighting fixtures and 90 degree edge connector arms of the assembly illustrated in FIG. 1, and more particularly show structure for achieving an edge connection between the connector arms and one of the edges of each lighting fixture of the assembly. As illustrated in these figures, each lighting fixture has an elongated housing 53 for housing a light source in the form of flourescent lamps 55 and for housing other components of the fixture, including lamp sockets 57, a bent reflector 59, and a ballast 61. The ballast is seen to be positioned in a ballast cavity 63 formed by the bent reflector and is anchored to the bottom of the housing by means of a T-slot 64. The housing itself is symmetrical about its longitudinal axis and includes laterally extending edge portions 65*a*, 65*b* and an interior region 66. Each of the laterally extending edge portions includes a top wall 67 and bottom wall 69 which project upwardly and outwardly from an internal bore 71 to form a keeper slot 73 that extends the length of the housing edge. The top wall of the keeper slot terminates in an upper edge face 75 slightly inclined back from vertical, while the bottom wall terminates in an lower edge face 77 which is similarly inclined. In addition to providing a connecting structure for receiving the connecting structure of the edge connector arms as hereinafter described, the edge faces 75, 77 and keeper slot 73 form a linear edge parallel to the longitudinal axis of the fixture housing which has a visually distinctive reveal. The edge faces 75, 77 catch light reflected off the surrounding ceiling and wall surfaces to provide sufficiently luminous surfaces to highlight the dark keeper slot.

Figure 4A:
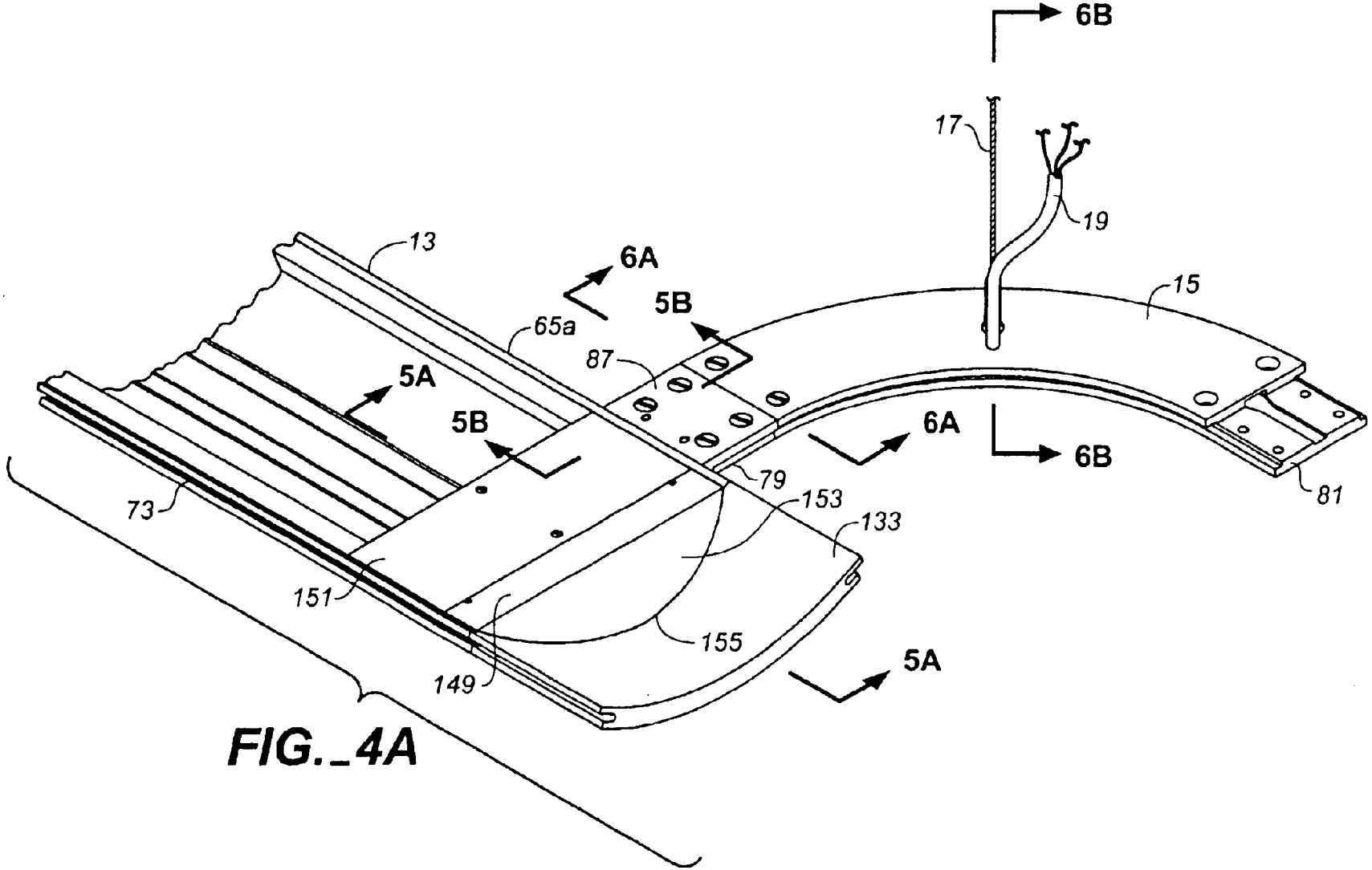
FIG. 4A is a top-perspective cut-away view of one corner of the square lighting fixture assembly shown in FIG. 1, showing in greater detail one of the assembled connector arms thereof.
Figure 4B:
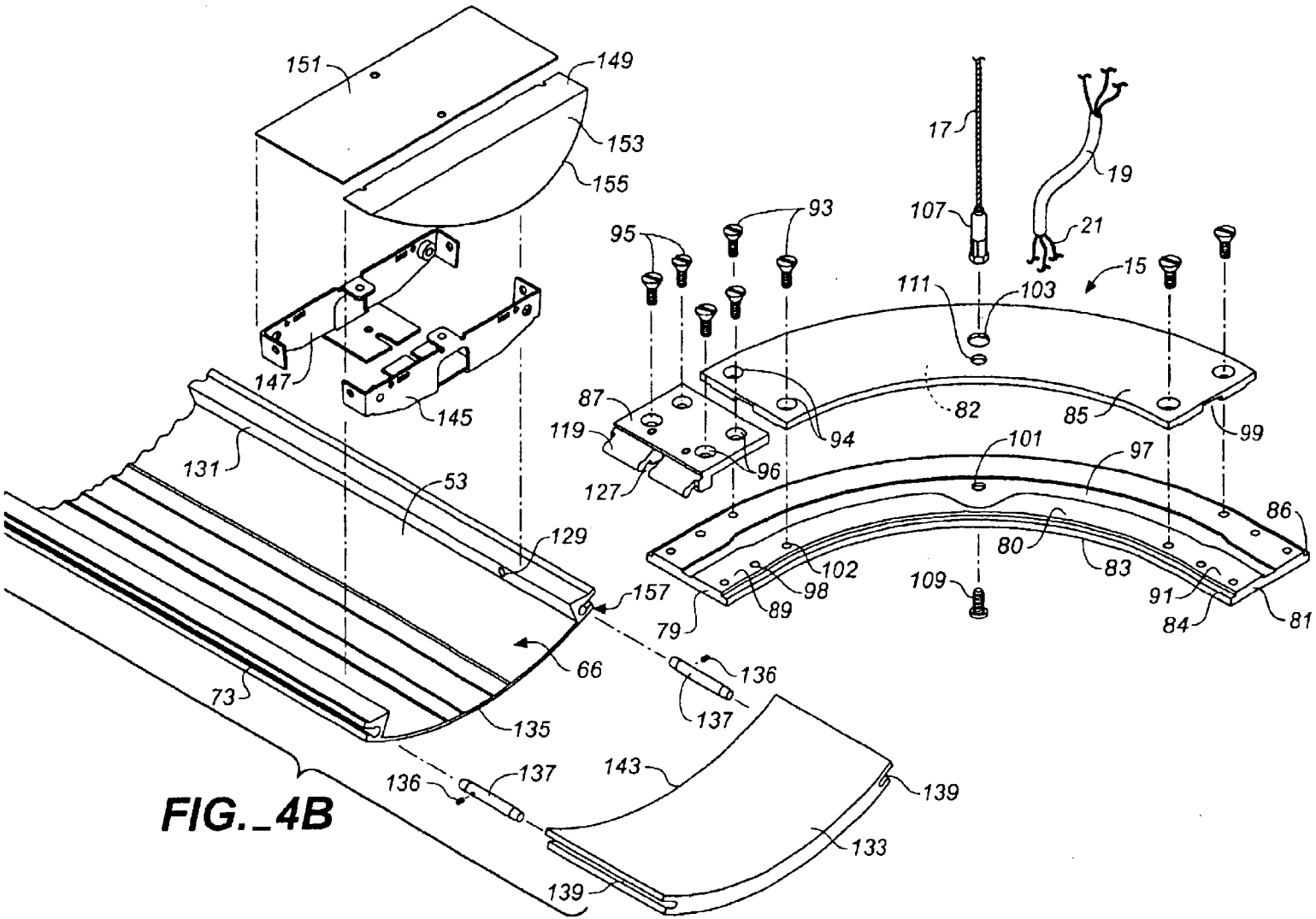
FIG. 4B is an exploded view of the corner of the lighting fixture assembly shown in FIG. 4A.
Figure 4C:
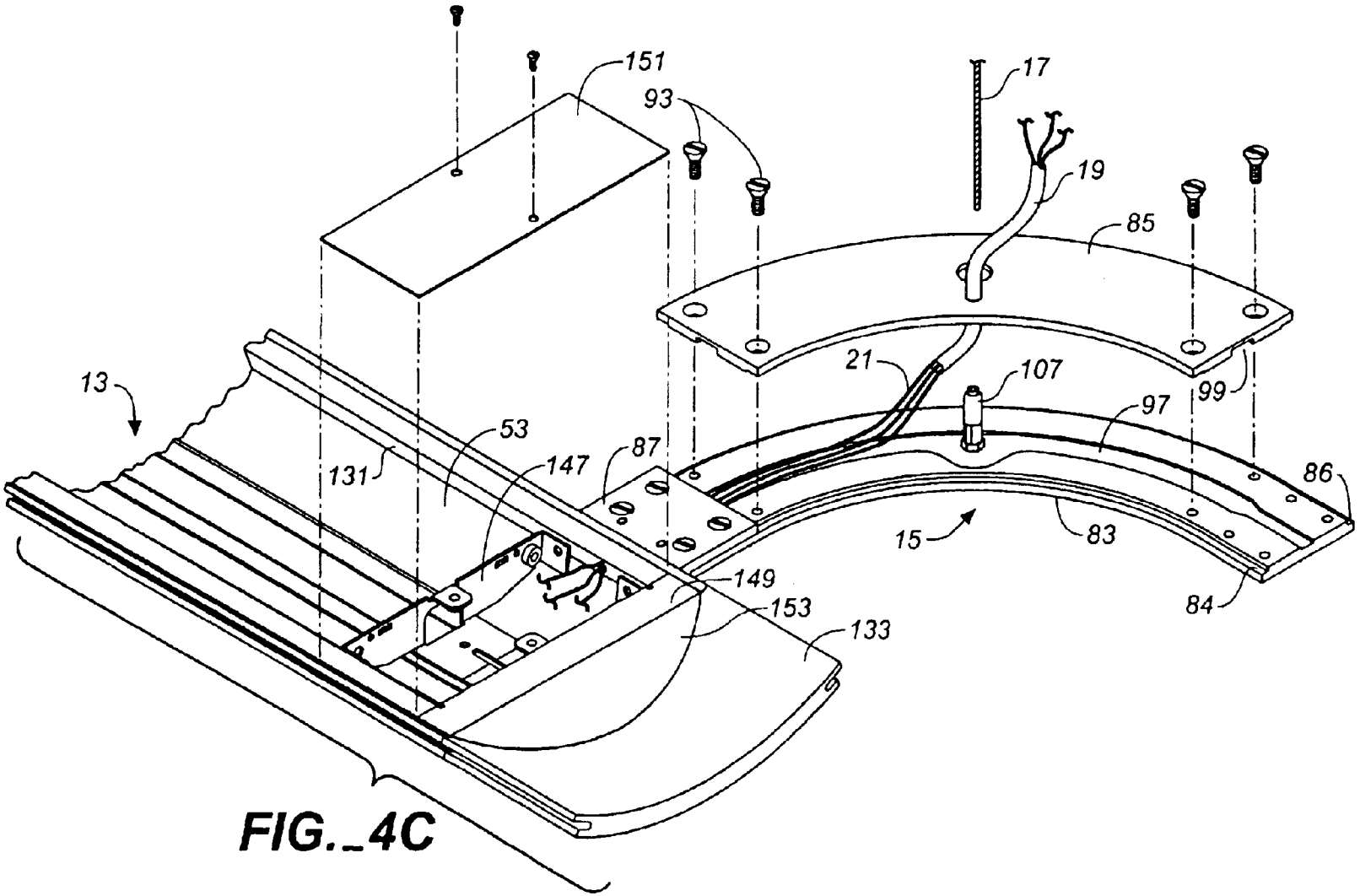
FIG. 4C is a further exploded view of the corner of the lighting fixture assembly shown in FIG. 4A, further showing the wiring of the lighting fixture assembly from its power feed location at the shown edge connector arm of the assembly.

The 90 degree edge connector arms 15 shown in FIG. 4A–4C include terminal ends 79, 81 having a connecting structure formed to mechanically connect with the keeper slot 73 at the housing's edge. More specifically, each edge connector arm is an assembly of parts comprised of a bottom plate 83 having top face 80, a top plate 85 having bottom face 82, and terminal connector plates 87. (For illustrative purposes only one terminal connector plate is shown in FIGS. 4A–4C.) The ends of the bottom plate have a attachment structure in the form of mounting surfaces 89, 91 to which the terminal connector plates 87 can be attached. The top plate is seen to be shorter than the bottom plate so it can be attached to the bottom plate between the connecter plates, as later described in greater detail.

Figure 6A:
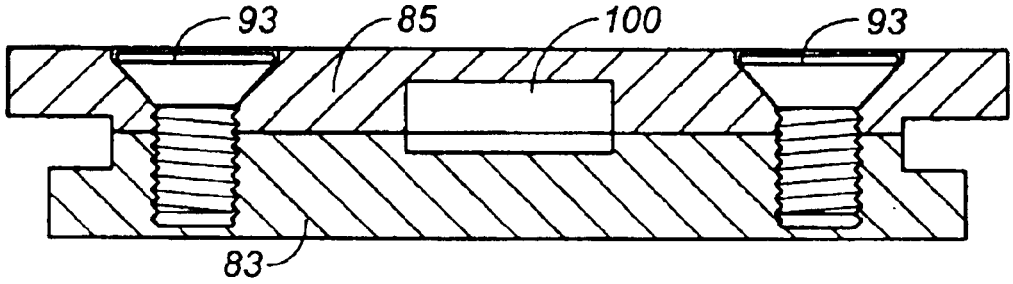
FIG. 6A is an enlarged cross-sectional view of the edge connector arm shown in FIG. 4A taken along lines 6A—6A.
Figure 6B:
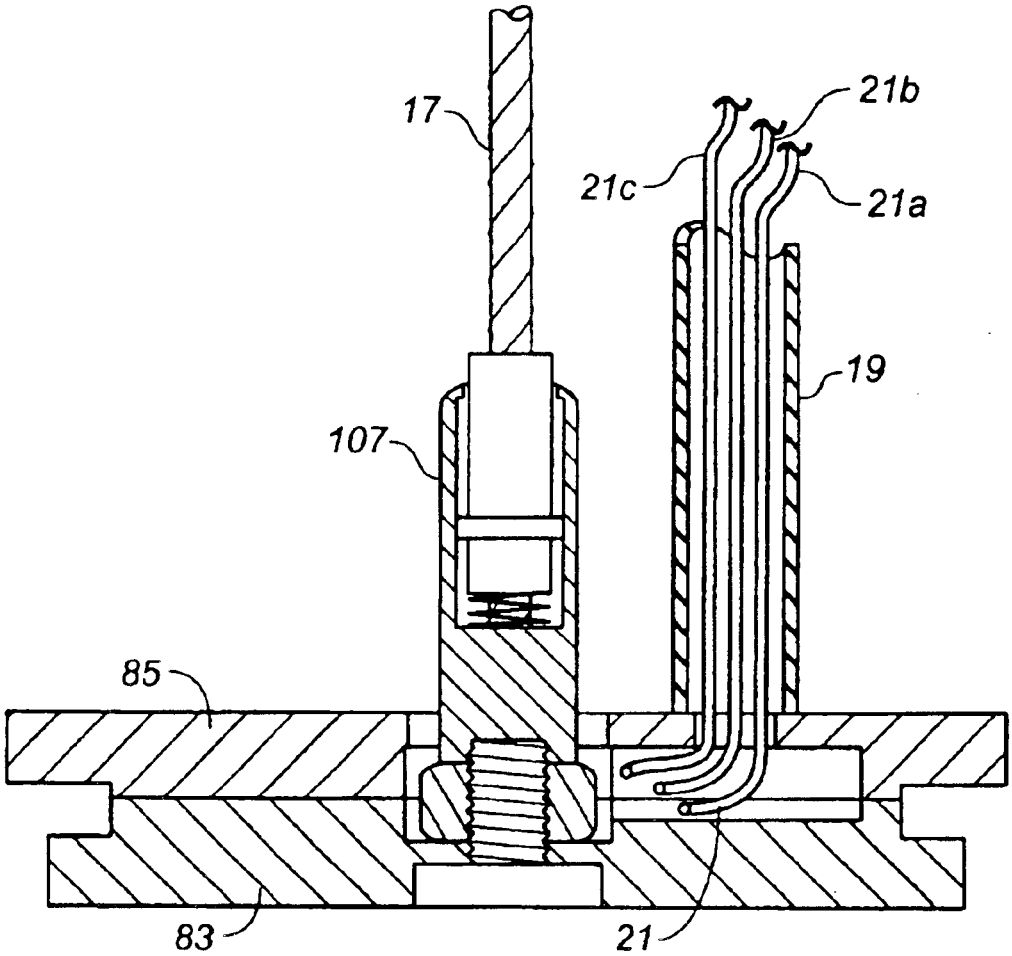
FIG. 6B is an enlarged cross-sectional view of the edge connector arm, hanger element, and power feed cord of the edge connector arm of FIG. 4A taken along lines 6B—6B of FIG. 4A.

The opposed faces 80, 82 of bottom plate 83 and top plate 85 of the edge connector arm include opposed channels 97, 99 extending the length of the plates which, when the plates are fastened together, form a wireway 100 through the arm as shown in FIG. 6A. Additionally, the bottom and top plates have opposed openings 101, 103 for receiving a suspension connector in the form of cable gripper 107 and cable gripper anchor screw 109, which provide a suspension point on this connector arm. A further opening 111 is provided in the top plate for feeding in the wires of power cord 19 as shown in FIG. 6B. It will be appreciated that one or more suspension points could be provided on the arm using different types of attachment mechanisms. It will also be appreciated that the gripper anchor screw could be affixed permanently to the connector arm. While the anchor screw or other attachment device is preferably secured from the bottom plate of the arm because it must support the weight of the fixtures of the assembly, securement to the top plate of the arm is also within the scope of the invention.

It is seen that the bottom plate 83 of the connector arm illustrated in FIGS. 4A–4C, has a stepped inner and outer edge 84, 86, which, when the connector arm is assembled as described below, produces a reveal along the edges of the arm which repeats the reveal formed along the edges 65*a*, 65*b* of the fixture housing. This has the advantage of integrating the components of the assembly into a uniform architectural theme.

Figure 7:
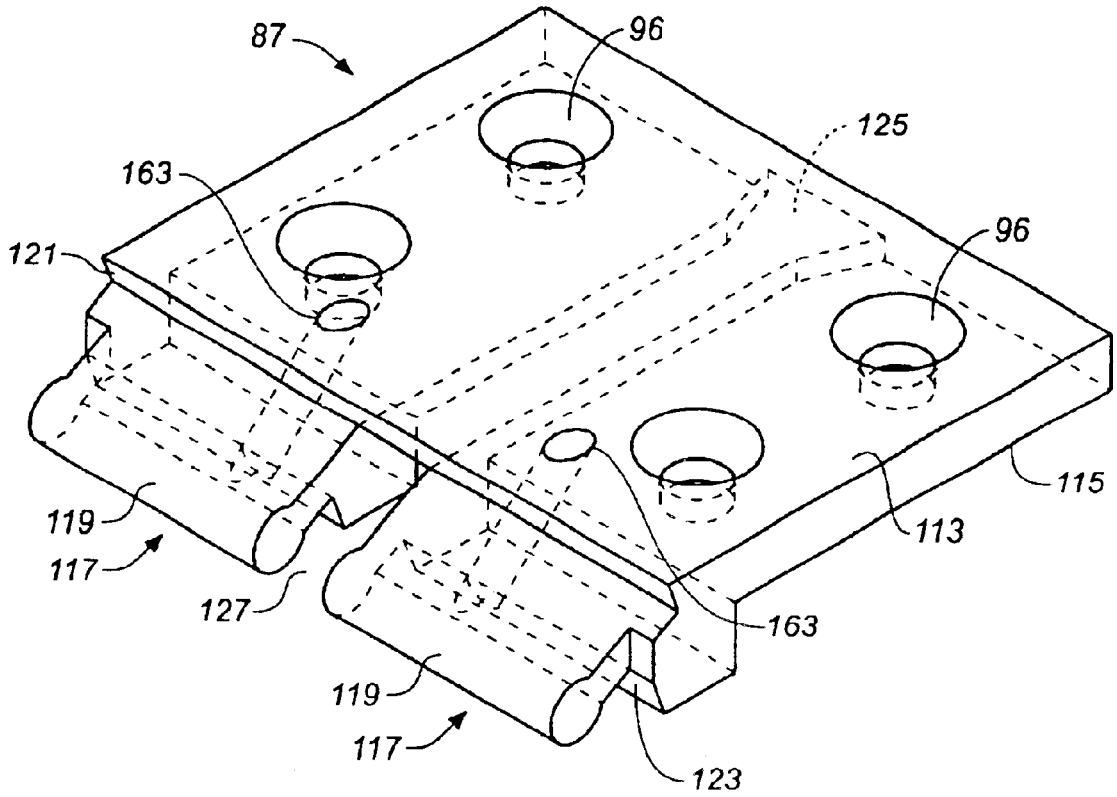
FIG. 7 is a top perspective view of the terminal connector plate of the edge connector arm of the invention.
Figure 8:
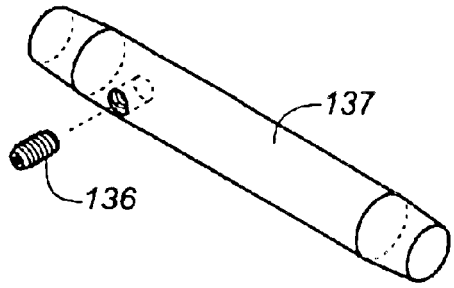
FIG. 8 is a top perspective view of one of the end cap pins for connecting the end caps of the lighting fixture to the lighting fixture housing and for providing a precisely positioned locator end for the terminal connector plate shown in FIG. 7.

The design of the terminal connector plates 87 of the edge connector arm is shown in greater detail in FIG. 7. The connecting plates provide a second connecting structure for mechanically connecting the connector arm to the above-described connecting structure formed along the housing edge.

Figure 3A:
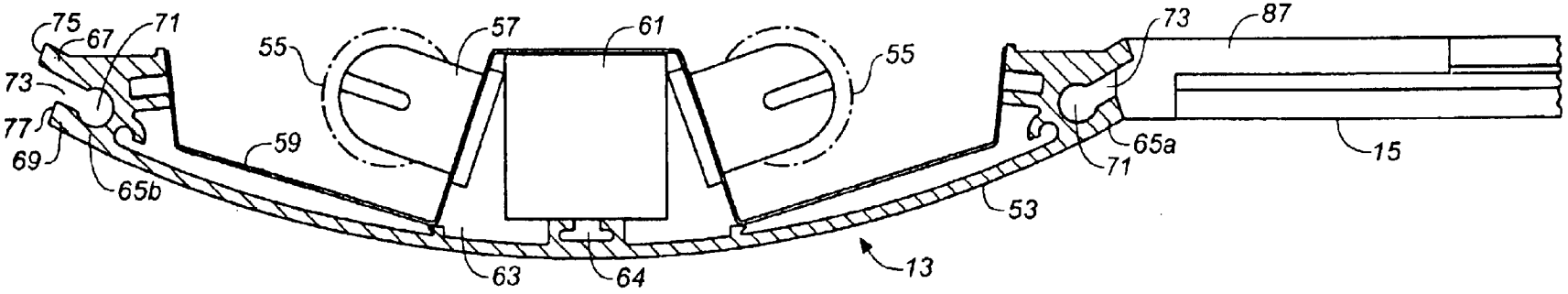
FIG. 3A is a cross-sectional view of the linear lighting fixtures shown in FIG. 2 taken along lines 3A—3A.
Figure 3B:
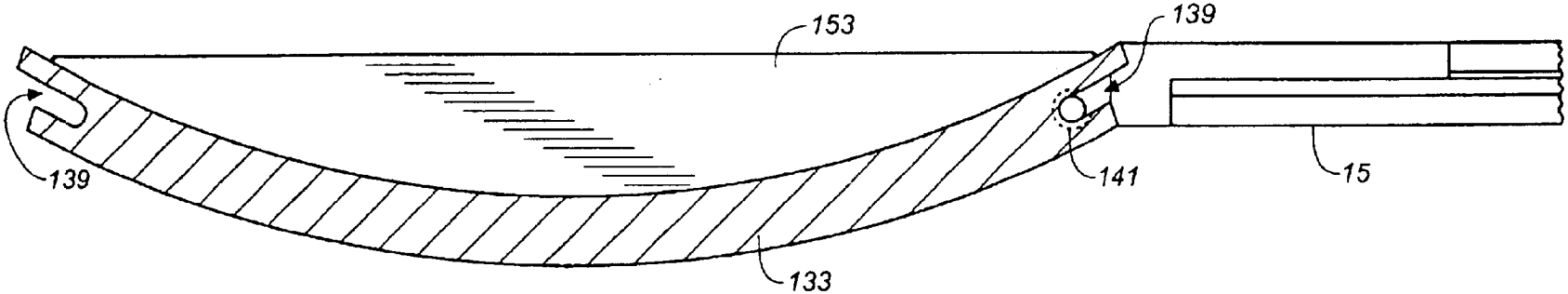
FIG. 3B is another cross-sectional view thereof taken along lines 3B—3B in FIG. 2.

Each connector plate has a top 113, a bottom 115, and a terminal end 117 which include keyed projections 119 formed to fit into and slide within a selected one of the keeper slots 73 formed along the extended edges 65*a*, 65*b* of the fixture housing 53. The terminal end 117 of the connector plate further includes top and bottom inclined faces 121, 123 designed to mate with and slide on the top and bottom edge faces 75, 77 forming the edge reveal of the housing (see FIG. 3A). Wire channel 125 formed along the bottom of the connector plate provides a continuation of the wireway 100 in the main body of the edge connector arm. This wire channel exits at the wire opening 127 between the keyed projections 119 to permit wires threaded through the connector arm's wireway to be threaded through the edge of the fixture housing to which the arm is connected, such as edge 65*a* as shown in FIGS. 3A and 4A. For this purpose, a wire passageway 129 is provided through each edge at each end of the housing a preset distance from the housing ends 135. This passageway is in the form of a drilled hole that extends from the base of the keeper slot to an interior vertical wall 131 behind the housing edge. As hereinafter described, wiring of the lighting fixtures of an assembly through the edge connector arm will require the alignment of the wire opening 127 of each terminal connector plate of the connector arm with an associated wire passageway 129 in each fixture housing.

It is noted that each end of the fixture housing is provided with an end cap such as the end cap 133 illustrated in FIGS. 4A–4B. End cap 133 is secured to the end 135 of the fixture housing 53 by means of attachment pins 137. Like the housing, the end cap has a uniform cross-sectional shape: it conforms to the shape of the housing and has edge reveals 139 that continue the edge reveals formed by keeper slots 73 on the housing edges. As shown by the phantom lines in FIG. 3B, a bore 141 is provided in each edge reveal 139 of the end cap at the cap's interior end 143 to receive connector pins 137. Bores 141 can suitably be sized to permit the pins to be press-fit into the end cap. They will also preferably be machined to a precise depth such that the pins 137 extend a known distance from the interior end of the cap. The pins can then be used to precisely locate the terminal connector plate 87 in the keeper slot in relation to the housing's wire passageway 129.

Figure 9:
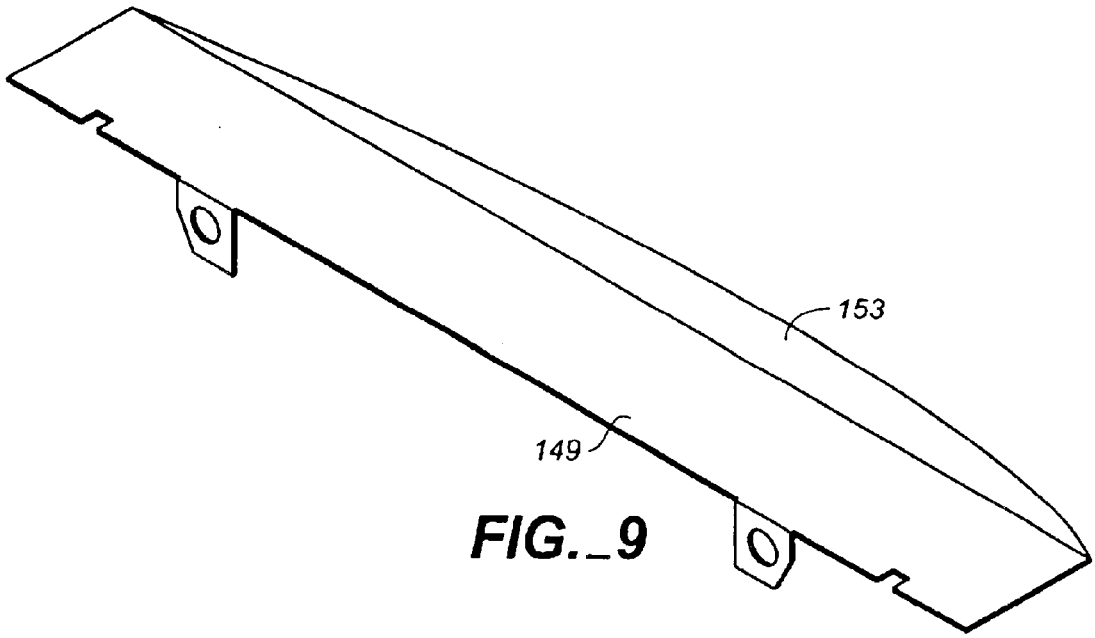
FIG. 9 is a top perspective view of an end cap cover plate for use at the junction created between the end cap and lighting fixture housing of the lighting fixture assembly.
Figure 10:
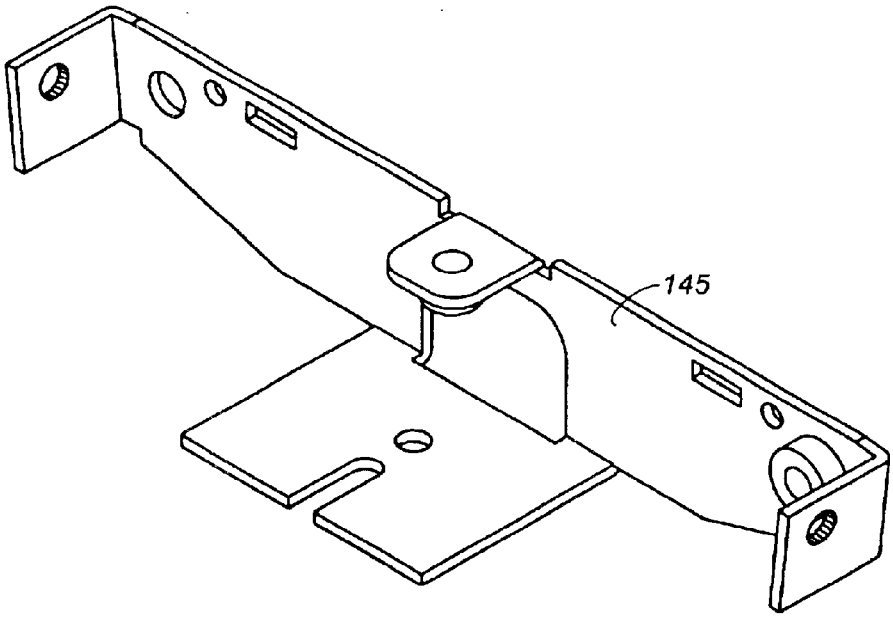
FIG. 10 is a top perspective view of a mounting bracket used in the assembly of the lighting fixture, including securing the end cap cover plate shown in FIG. 9.

As shown in FIGS. 4B and 4C, brackets 145, 147 are provided for securing end cap cover plate 149 and top cover plate 151 to the end of the fixture housing. Brackets 145, 147 are identical brackets and are shown in greater detail in FIG. 10. End cap cover plate 149, shown in greater detail in FIG. 9, is seen to have forwardly angled front wall 153 with a bottom edge 155 that is curved to conform to the curvature of end cap 133 when the cover plate is secured in place. When the fixture is viewed from the end, an observer will see only the front wall of the end cover instead of unsightly hardware and wiring behind the cover. By providing the end wall with different finishes and colors, the end cap cover plate can be advantageously used as an accent element of the fixture. The top cover plate 151 covers the area between brackets and provides an enclosed cavity within the housing for containing the wire connections made between the internal fixture wires and the wiring from the connector arms.

Because of their uniform shape the fixture housing and end caps can be extruded and will suitably be extruded aluminum parts cut to desired lengths. The extruded end caps illustrated in the drawings will eliminate the need for the more expensive die cast ends used in most conventional linear lighting systems.

The assembly of the edge connector arm and its connection to the edge of the lighting fixture of the assembly is now described with reference to FIGS. 4A–4C and 5A–5B. The connection of one terminal end of one edge connector arm to one end of one lighting fixture is described. The connection procedure as described will be repeated at each point of connection between the edge connector arms and the lighting fixtures of an assembly. The only difference from one corner to the next is at the power feed location where the power cord 19 is located. The power feed cord will be wired to the first fixture of the assembly whereas with the other connection points, the fixtures are simply wired one to the other as hereinafter described.

The first step of connecting one edge of the edge connector arm to the fixture is to remove the fixture's end cap 133. Here it is noted that the diameter of the bore 71 at the base of the keeper slot is chosen to allow the end cap pins 137 to freely slide within keeper slot 73. Allen-head set screws 136 (FIG. 4B) are provided in the end cap pins to permit the end cap to be locked into place when the pins are fully inserted. The set screws, which pass through the keeper slot, can be accessed by an Allen-head wrench inserted through the edge of the fixture.

With the end cap removed, a terminal connector plate 87 of the edge connector arm is engaged in the housing's keeper slot by sliding the keyed projections 119 of the terminal connector plate into the slot from the slot access point 157 at the housing's end 135. The end cap is then replaced and tightened down by means of the set screws 136.

Figure 5A:
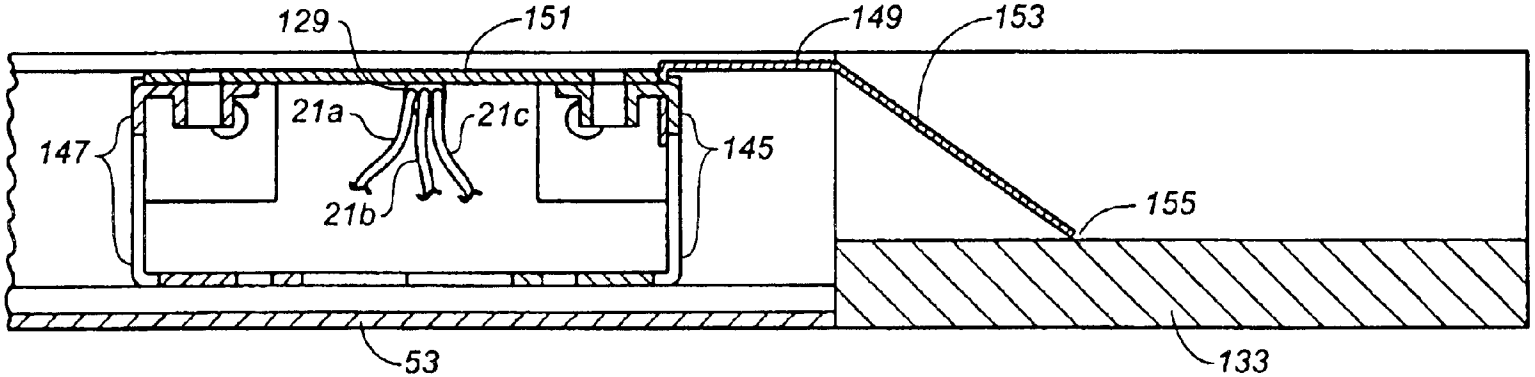
FIG. 5A is an enlarged fragmentary cross-sectional view in side elevation of the corner of the lighting fixture assembly shown in FIG. 4A taken along lines 5A—5A.
Figure 5B:
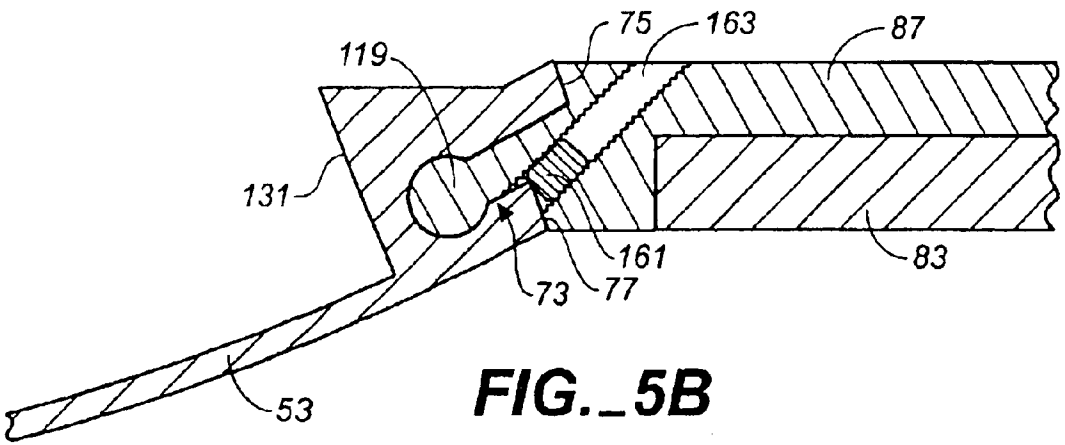
FIG. 5B is an enlarged fragmentary cross-sectional view of the connection between the lighting fixture housing and the edge connector arm as seen from lines 5B—5B of FIG. 4A.

Once this is accomplished, the terminal connector plate is aligned with the wire passageway 129 of the fixture housing by sliding the connector plate up against the locator end of the end cap pin 137 engaged in that slot. As mentioned above, a pin length is chosen which achieves this alignment. When the terminal connector plate is in position, it must be locked into place by the plate locking mechanism illustrated in FIGS. 5B and 7. This mechanism consists of a pair of connector plate set screws 161 screwed into threaded attack holes 163 which extend downwardly at an angle from the top of the terminal connector plate 87 to the bottom face 123 of the plate's terminal end 117. Like the end cap pin set screws 136, connector plate set screws 161 are also suitably Allen-head screws which are advanced in attack holes 163 of the terminal connector plate by means of an Allen-wrench. When fully advanced these set screws contact and press against the bottom face 77 of the housing's edge reveal as shown in FIG. 5B so as to lock the connector plate in position. The downward attack angle of the set screws illustrated in FIG. 5B has the advantage of counter-acting the torque caused by the weight of the housing at the joint between the housing and connector arm. It thus inhibits the tendency of the housing to sag at this joint.

Once the terminal connector plates 87 are locked onto all the lighting fixture housings of the assembly, assembly of the rest of the edge connector arms and wiring of the assembly can be completed. This is suitably accomplished on the ground before the lighting fixture assembly is hung from the suspension cables (see cables 17 in FIG. 1) that suspend the lighting fixture assembly below the overhead ceiling. Also, wiring of the assembly is suitably accomplished first before the connector arms are assembled.

A suitable procedure for wiring the four fixture assembly shown in FIG. 1 is now described with reference to FIGS. 1, 1A and 4A thru 4C. To wire this assembly, the outer cover of power cord 19 is stripped away at one end to expose three insulated wires 21*a*, 21*b*, 21*c* to a sufficient length to allow the wires to be run from the top of the later assembled edge connector arm 15 through the connector arm's wireway 100 and from there into the housing 53 of the initial fixture 13*a* (see FIG. 4C). This entry point is at corner A of the illustrated four fixture assembly. The stripped power cord wires are threaded through the wire opening 127 of the terminal connector plate 87 attached to one end of initial fixture 13*a* (see FIG. 4B) and on through the aligned wire passageway 129 at the edge of the housing. From the inside of the housing the ends of the power cord wires are pulled through and spliced with the internal wires 23*a*, 23*b*, 23*c* of this initial fixture as graphically illustrated in FIG. 1A. The extra length of wires 23*a*, 23*b*, 23*c* at the other end of this initial fixture (located at a corner B of the assembly) is then pulled through a similar wire passageway at this other end of the fixture and through a similarly attached terminal connector plate aligned therewith. From there the extra length of wire is pulled through the terminal connector plate and wire passageway at the end of the next adjacent fixture at corner B of the assembly where they are spliced to the internal wires 25*a*, 25*b*, 25*c* of the next fixture 13*b* of the assembly. This wiring procedure is repeated to splice together the internal wires of fixture 13*b* to the internal wires 29*a*, 29*b*, 20*c* of the next in line fixture 13*c* at corner C of the assembly, and wires of fixture 13*c* to the internal wires 31*a*, 31*b*, 31*c* of end-of-the-line fixture 13*d*. As above mentioned, the end-of-the-line fixture wires are suitably terminated at terminal block 33.

Once the wiring is completed, the bottom plate 83 of the edge connector arm is fastened to the terminal connector plates by means of screw fasteners 95 as shown is FIG. 4B. The screw fasteners extend through screw openings 96 in the connector plate so as to screw into the threaded screw holes 98 of the bottom plate. The cable gripper 107 is then attached to the bottom plate by means of anchor screw 109, and the top plate 85 of the edge connector arm fastened down onto the bottom plate 83 by means of screw fasteners, such as the illustrated screw fasteners 93, that are screwed into threaded holes 102 in the bottom plate through fastener openings 94 in the top plate. Before fastening the top plate, care must be taken to place the wires pulled between the fixtures into the wire channel 97 of the bottom plate such that the wires are completely captured in the connector arm's wireway 100 after the arm is assembled.

Once the assembly is complete, it can be lifted to permit the suspension cables 17 to be threaded into the suspension connectors, such as cable grippers 107, which project up through gripper opening 103 in the top of the edge connector arm. The suspension cable gripper illustrated in detail in FIG. 4B is a commercially available component widely used in the industry. Once suspended the top free end of the length of power cord 19 can be wired to a junction box above the ceiling (not shown).

The above-described installation steps may vary depending on the preference of the installer and the nature of the assembly. For example, in the assembly shown in FIG. 2, the installation would involve fewer and simpler steps since only two fixtures need to be wired together through two relatively short edge connector arms.

Figure 11:
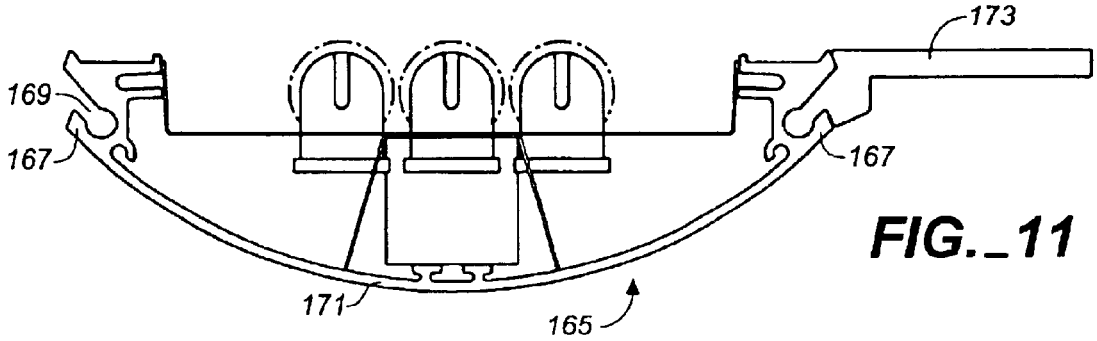
FIG. 11 is a cross-sectional end elevational view of a portion of another edge connectable linear lighting fixture assembly in accordance with the invention, showing a different style of lighting fixture.
Figure 12:
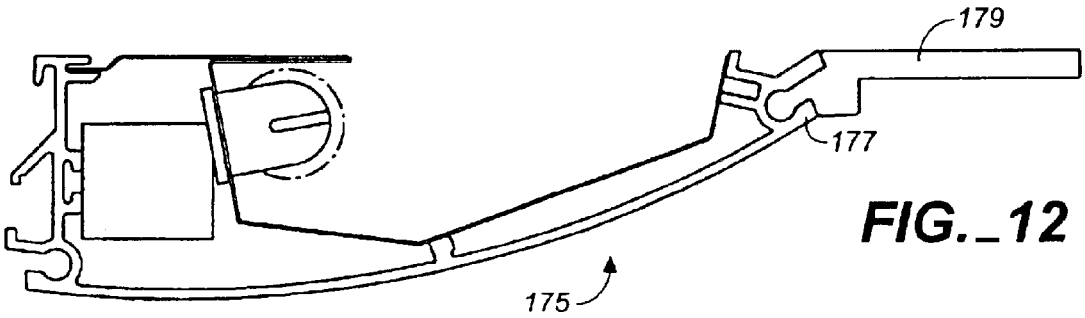
FIG. 12 is a cross-sectional end elevational view of a portion of another edge connectable linear lighting fixture assembly in accordance with the invention, showing the use of a wall mounted fixture, instead of a ceiling suspended fixture.
Figure 13:
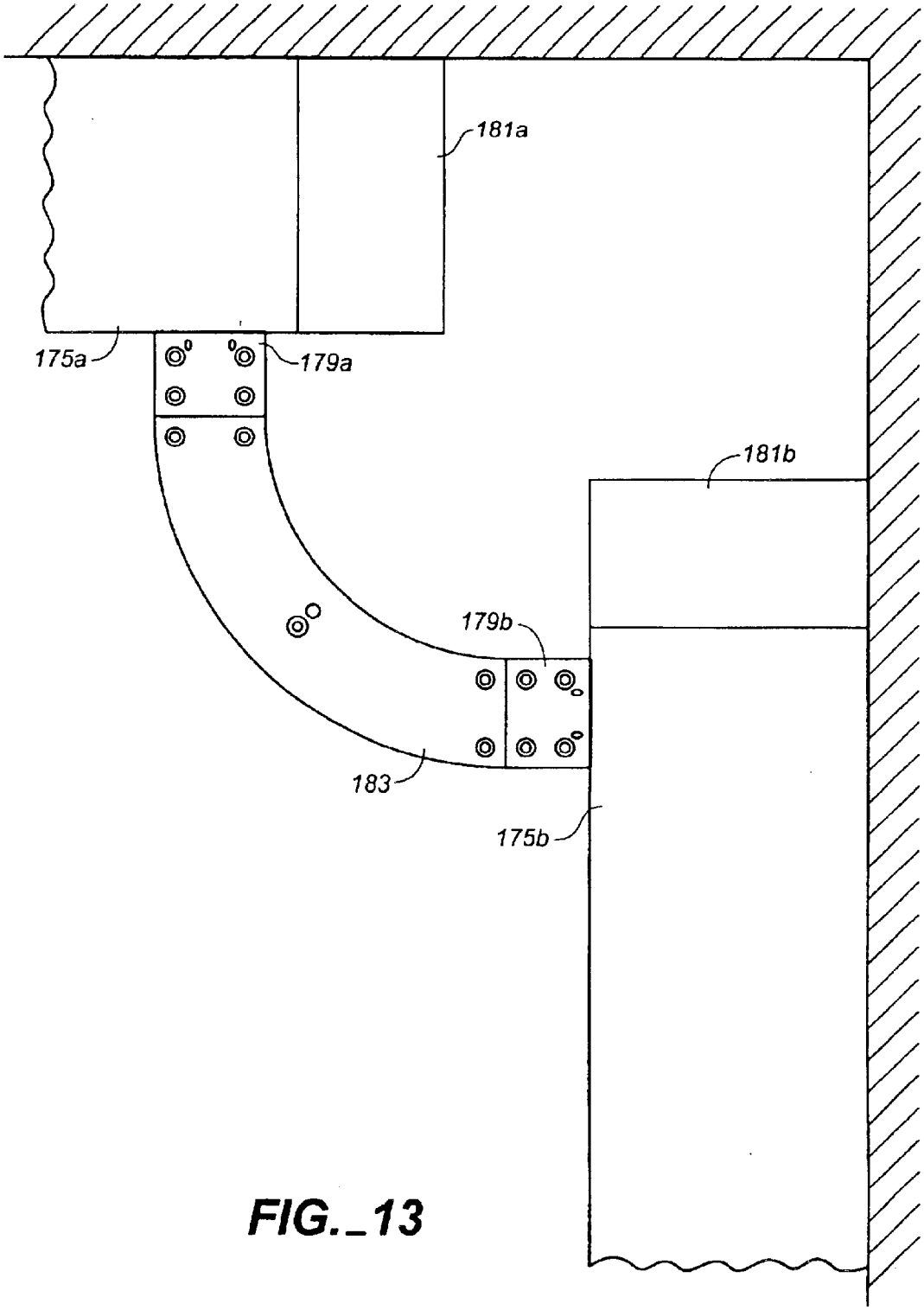
FIG. 13 is a bottom plan view of edge connectable linear lighting fixture assembly in accordance with the invention using wall-mounted linear lighting fixtures such as shown in FIG. 12.

FIGS. 11–13 show examples of different types and shapes of lighting fixtures that might be used with the edge connector system of the invention. FIG. 11 shows a three-lamp flourescent lighting fixture 165 having laterally extending edge portions 167 with key slots 169 which are more steeply oriented than the key slots of the previously described embodiment, due to the steeper curvature of the fixture housing 171. For illustrative purposes, a terminal connector plate 173 designed to conform to the edge of the fixture housing of this embodiment is shown on the right side edge of the fixture. In FIG. 12, fixture 175 is a wall-mounted fixture having a single laterally extending edge 177 to which a terminal connector plate 179 at the terminal end of an edge connector arm can be connected.

FIGS. 13 illustrates how a 90 degree edge connector arm might be used in connection with wall-mounted fixtures such as shown in FIG. 12. In FIG. 13, two wall-mounted fixtures 175*a*, 175*b* having end caps 181*a*, 181*b* similar to the end caps previously described are interconnected by means of edge connector arm 183 having terminal connector plates 179*a*, 179*b*. While connector arm 183 does not support the fixtures 175*a*, 175*b* in this instance, it does provide an architectural element to the lighting system as well as a wireway for wiring one wall-mounted fixture to another. Wiring one fixture to another in this configuration can be accomplished relatively easily with the top plate of the connector arm removed.

Thus, it is appreciated that the present invention provides an edge connectable linear lighting fixture assembly that can be easily interconnected mechanically and electrically, that is aesthetically pleasing, and that provides a lighting designer with a powerful tool for creating overhead lighting systems with an architectural motif that has not heretofore existed. While the invention has been described in considerable detail in the foregoing specification, it is not intended that the invention be limited to such detail, except as necessitated by the following claims.

What we claim is:

1. A method of connecting together a lighting fixture assembly which includes a lighting fixture housing for housing a light source and components for supporting and electrifying the light source including wiring, said housing having at least one laterally extending edge portion and a first connecting structure extending along at least a portion of the length of said edge portion, said first connecting structure having at least one wire passageway therethough, an edge connector arm having at least one terminal end, the terminal end of said edge connector arm having a second connecting structure formed to mechanically connect with the first connecting structure along the edge portion of said housing, and a wireway in said edge connector arm, said wireway extending to and exiting the at least one terminal end of said edge connector arm, said method comprising connecting said housing and the terminal end of said edge connector arm together at the edge of said housing by means of the connecting structures, aligning the wireway in said connector arm with the at least one wire passageway in the first connecting structure in said housing edge portion by aligning the terminal end of the edge connector arm to said wire passageway, and passing said electrical wires through the edge portion of said housing.

2. The method of claim 1 wherein the first connecting structure along the edge portion of said housing has a uniform cross-section and slidably receives the second connecting structure at the terminal end of said edge connector arm such that the terminal end of said edge connector arm can be positioned along said housing edge by sliding its second connecting structure along the first connecting structure on the lateral edge of said housing.

3. The method of claim 2 wherein the first connecting structure extending along the edge portion of said housing includes a keeper slot formed along at least a portion of the length of said housing edge, and wherein the second connecting structure at the terminal end of said edge connector arm includes at least one keyed projection formed to be received by the keeper slot of said housing edge portion, wherein the step of connecting said housing and the terminal end of said edge connector arm together includes engaging the keyed projection at the terminal end of said connecting arm in the keeper slot formed on the edge portion of said housing, and further wherein the step of aligning the wireway in said connector arm with the at least one wire passageway in the first connecting structure in said housing edge portion includes sliding the keyed projection of the terminal end of said edge connector arm within the keeper slot.

4. The method of claim 3 wherein said keeper slot the keyed projection at the terminal end of said connecting arm engages said keeper slot at an access point in said keeper slot.

5. The method of claim 1 wherein said housing is an elongated linearly shaped housing having at least one laterally extending lateral edge portion to which the terminal end of said edge connector arm can be connected.

6. The method of claim 5 wherein said elongated housing is symmetrically shaped and has two laterally extending and oppositely directed edge portions, each of which has a first connecting structure extending along at least a portion of the length of said edge portion and each of which has at least one wire passageway therethrough, such that the terminal end of said edge connector arm can be connected to and wired through either edge portion of said housing.

7. The method of claim 1 wherein said edge connector arm has two terminal ends, each of said terminal ends having a second connecting structure formed to mechanically connect with the first connecting structure along the edge portion of said housing, and wherein said housing can be mechanically connected to either of the terminal ends of said edge connector arm at the edge of said housing.

8. The method of claim 7 comprising at least two lighting fixture housings, each said housing having at least one laterally extending edge portion and a first connecting structure extending along at least a portion of the length of said edge portion, said first connecting structure having at least one wire passageway therethough such that each said housing can be mechanically connected to one of the terminal ends of said edge connector arm at the edge of said housing such that said edge connector arm can be used to interconnect the at least two housings of the lighting fixture assembly.

9. The method of claim 1 wherein said edge connector arm is an assembly comprised of:

a terminal connector plate at the terminal end of said connector arm, said terminal connector plate containing the second connecting structure of said connector arm and operative to provide a mechanical connection between said connector arm and the first connecting structure located along the edge portion of said housing, and a bottom plate having an end and a top face, said connector plate being attachable to the end of said bottom plate, and the top face of said bottom plate having a wire channel that runs to the ends of said bottom plate, said wire channel providing at least a portion of the wireway of said connector arm.

10. The method of claim 9 wherein said connector arm assembly further comprises a top plate attachable to the top of said bottom plate for covering the wire channel of said bottom plate and for providing an enclosed wireway within said edge connector arm.

11. The method of claim 1 wherein said connector arm includes at least one suspension point to which a suspension cable or other suspension means can be attached for suspending the lighting fixture assembly from an overhead structure such as a ceiling.

* * * * *